US010192662B2

(12) United States Patent
Watanabe et al.

(10) Patent No.: US 10,192,662 B2
(45) Date of Patent: Jan. 29, 2019

(54) METHOD FOR PRODUCING GRAIN-ORIENTED ELECTRICAL STEEL SHEET

(71) Applicant: JFE STEEL CORPORATION, Chiyoda-ku, Tokyo (JP)

(72) Inventors: Makoto Watanabe, Tokyo (JP); Takeshi Imamura, Tokyo (JP); Ryuichi Suehiro, Tokyo (JP); Toshito Takamiya, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 416 days.

(21) Appl. No.: 14/767,718

(22) PCT Filed: Feb. 12, 2014

(86) PCT No.: PCT/JP2014/053158
§ 371 (c)(1),
(2) Date: Aug. 13, 2015

(87) PCT Pub. No.: WO2014/126089
PCT Pub. Date: Aug. 21, 2014

(65) Prior Publication Data

US 2016/0020006 A1 Jan. 21, 2016

(30) Foreign Application Priority Data

Feb. 14, 2013 (JP) ..... 2013-026209

(51) Int. Cl.
*C21D 8/12* (2006.01)
*H01F 1/147* (2006.01)
(Continued)

(52) U.S. Cl.
CPC ..... *H01F 1/14775* (2013.01); *C21D 3/04* (2013.01); *C21D 6/004* (2013.01); *C21D 6/005* (2013.01);
(Continued)

(58) Field of Classification Search
None
See application file for complete search history.

(56) References Cited

U.S. PATENT DOCUMENTS 4,268,326 A * 5/1981 Iwayama ..... C21D 3/04 148/111
4,576,658 A 3/1986 Inokuti
(Continued)

FOREIGN PATENT DOCUMENTS

CN 1254021 5/2000
CN 102812133 12/2012
(Continued)

OTHER PUBLICATIONS

Machine translaion of JPS63-105926, May 1988.*
(Continued)

*Primary Examiner* — Xiaowei Su
(74) *Attorney, Agent, or Firm* — RatnerPrestia

(57) ABSTRACT

In a method for producing a grain-oriented electrical steel sheet by comprising a series of steps of hot rolling a raw steel material comprising C: 0.002-0.10 mass %, Si: 2.0-8.0 mass %, and Mn: 0.005-1.0 mass %, subjecting the steel sheet to a hot band annealing as required, cold rolling to obtain a cold rolled sheet having a final sheet thickness, subjecting the steel sheet to primary recrystallization annealing combined with decarburization annealing, applying an annealing separator to the steel sheet surface and then subjecting to final annealing, rapid heating is performed at a rate of not less than 50° C./s in a region of 200-700° C. in the heating process of the primary recrystallization annealing, and the steel sheet is held at any temperature of 250-600° C. in the above region for 1-10 seconds, while a soaking process of the primary recrystallization annealing is controlled to a temperature range of 750-900° C., a time of 90-180 seconds and $P_{H2O}/P_{H2}$ in an atmosphere of 0.25-
(Continued)

0.40, whereby a grain-oriented electrical steel sheet being low in the iron loss and small in the deviation of the iron loss value is obtained.

20 Claims, 1 Drawing Sheet

(51) Int. Cl.

| | |
|---|---|
| ***C22C 38/04*** | (2006.01) |
| ***C22C 38/60*** | (2006.01) |
| ***H01F 1/16*** | (2006.01) |
| ***C22C 38/00*** | (2006.01) |
| ***C22C 38/02*** | (2006.01) |
| ***C22C 38/06*** | (2006.01) |
| ***C22C 38/12*** | (2006.01) |
| ***C22C 38/34*** | (2006.01) |
| ***C21D 3/04*** | (2006.01) |
| ***C21D 6/00*** | (2006.01) |
| ***C21D 9/46*** | (2006.01) |
| ***C22C 38/16*** | (2006.01) |
| ***C22C 38/40*** | (2006.01) |
| ***C23C 8/26*** | (2006.01) |
| ***H01F 41/02*** | (2006.01) |

(52) U.S. Cl.

CPC ..... *C21D 6/008* (2013.01); *C21D 8/1261* (2013.01); *C21D 8/1272* (2013.01); *C21D 9/46* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/12* (2013.01); *C22C 38/16* (2013.01); *C22C 38/34* (2013.01); *C22C 38/40* (2013.01); *C22C 38/60* (2013.01); *C23C 8/26* (2013.01); *H01F 1/16* (2013.01); *H01F 41/02* (2013.01); *C21D 8/1222* (2013.01); *C21D 8/1233* (2013.01); *C21D 8/1255* (2013.01); *C21D 8/1277* (2013.01); *C21D 8/1283* (2013.01)

(56) References Cited

U.S. PATENT DOCUMENTS

| | | | | |
|---|---|---|---|---|
| 4,975,127 | A | 12/1990 | Kurosawa | |
| 5,082,509 | A | 1/1992 | Ushigami | |
| 5,571,342 | A | 11/1996 | Komatsubara | |
| 7,833,360 | B2 | 11/2010 | Kumano | |
| 2002/0000265 | A1 | 1/2002 | Toda | |
| 2002/0139444 | A1 | 10/2002 | Kosuge | |
| 2009/0032142 | A1* | 2/2009 | Kumano | C21D 8/12 148/111 |
| 2011/0180187 | A1 | 7/2011 | Ji | |
| 2012/0013430 | A1 | 1/2012 | Morishige | |
| 2013/0074996 | A1 | 3/2013 | Omura | |

FOREIGN PATENT DOCUMENTS

| | | |
|---|---|---|
| EP | 2933348 | 10/2015 |
| JP | 54160514 | 12/1979 |
| JP | 60121222 | 6/1985 |
| JP | 63105926 | 5/1988 |
| JP | 0277526 | 3/1990 |
| JP | 07062436 | 3/1995 |
| JP | 08188824 | 7/1996 |
| JP | 10130729 | 5/1998 |
| JP | 10152724 | 6/1998 |
| JP | 10298653 | 11/1998 |
| JP | 2983129 | 11/1999 |
| JP | 2003027194 | 1/2003 |
| JP | 2010236013 | 10/2010 |
| KR | 20110139753 | 12/2011 |
| RU | 2085598 | 7/1997 |
| RU | 2378393 | 1/2010 |
| RU | 2457260 | 7/2012 |
| WO | 2014017589 | 1/2014 |

OTHER PUBLICATIONS

English Abstract of JP63-105926A, May 1988.*
English claims of JP63-105926A, May 1988.*
Russian Office Action for Russian Application No. 2015138907, dated Dec. 12, 2016, including English translation, 14 pages.
Canadian Office Action for Canadian Application No. 2,897,586, dated Nov. 7, 2016, 3 pages.
International Search Report for International Application No. PCT/JP2014/053158 dated May 13, 2014.
Supplemental European Search Report dated Feb. 17, 2016 in European Application No. 14752108.2-1362.
Chinese Office Action for Chinese Application No. 201480004145.7 dated Mar. 21, 2016.
Korean Office Action for Korean Application No. 10-2015-7016361 with concise statement of relevance, dated Apr. 22, 2016.
Extended European Search Report dated Jun. 15, 2016 for European Application No. 14752108.2, 11 pages.

* cited by examiner

METHOD FOR PRODUCING GRAIN-ORIENTED ELECTRICAL STEEL SHEET

CROSS REFERENCE TO RELATED APPLICATIONS

This is the U.S. National Phase application of PCT International Application No. PCT/JP2014/053158 filed Feb. 12, 2014, and claims priority to Japanese Patent Application No. 2013-026209 filed Feb. 14, 2013, the disclosures of each of these applications being incorporated herein by reference in their entireties for all purposes.

FIELD OF THE INVENTION

This invention relates to a method for producing a grain-oriented electrical steel sheet, and more particularly to a method for producing a grain-oriented electrical steel sheet which is low in the iron loss and small in the deviation of iron loss.

BACKGROUND OF THE INVENTION

The electrical steel sheets are soft magnetic materials widely used as iron cores for transformers, motors or the like. Among them, the grain-oriented electrical steel sheets are excellent in the magnetic properties because their crystal orientations are highly accumulated into {110}<001> orientation called as Goss orientation, so that they are mainly used as iron cores for large-size transformers or the like. In order to decrease no-load loss (energy loss) in the transformer, the iron loss is required to be low.

As a method for decreasing the iron loss in the grain-oriented electrical steel sheet, it is known that the increase of Si content, the decrease of sheet thickness, the high accumulation of crystal orientations, the application of tension to steel sheet, the smoothening of steel sheet surface, the refining of secondary recrystallized grains and so on are effective.

As a technique for refining secondary recrystallized grains among these methods is proposed a method wherein the steel sheet is subjected to a heat treatment by rapid heating in decarburization annealing or rapid heating just before decarburization annealing to improve primary recrystallized texture. For example, Patent Document 1 discloses a technique of obtaining a grain-oriented electrical steel sheet with a low iron loss wherein a cold rolled steel sheet with a final thickness is rapidly heated to a temperature of not lower than 700° C. at a rate of not less than 100° C./s in a non-oxidizing atmosphere having $P_{H2O}/P_{H2}$ of not more than 0.2 during decarburization annealing. Also, Patent Document 2 discloses a technique wherein a grain-oriented electrical steel sheet with a low iron loss is obtained by rapidly heating a steel sheet to 800-950° C. at a heating rate of not less than 100° C./s while an oxygen concentration in the atmosphere is set to not more than 500 ppm and subsequently holding the steel sheet at a temperature of 775-840° C. which is lower than the temperature after the rapid heating and further holding the steel sheet at a temperature of 815-875° C. Further, Patent Document 3 discloses a technique wherein an electrical steel sheet having excellent coating properties and magnetic properties is obtained by heating a steel sheet to not lower than 800° C. in a temperature range of not lower than 600° C. at a heating rate of not less than 95° C./s with properly controlling an atmosphere in this temperature range. In addition, Patent Document 4 discloses a technique wherein a grain-oriented electrical steel sheet with a low iron loss is obtained by limiting N content as AlN precipitates in the hot rolled steel sheet to not more than 25 ppm and heating to not lower than 700° C. at a heating rate of not less than 80° C./s during decarburization annealing.

In these techniques of improving the primary recrystallized texture by rapid heating, the temperature range for rapid heating is set to a range of from room temperature to not lower than 700° C., whereby the heating rate is defined unambiguously. Such a technical idea is attempted to improve the primary recrystallized texture by raising the temperature close to a recrystallization temperature in a short time to suppress development of γ-fiber ({111}<uvw> texture), which is preferentially formed at a common heating rate, and to promote the generation of {110}<001> texture as a nucleus for secondary recrystallization. By applying these techniques are refined crystal grains after the secondary recrystallization (grains of Goss orientation) to improve the iron loss property.

PATENT DOCUMENTS

Patent Document 1: JP-A-H07-062436
Patent Document 2: JP-A-H10-298653
Patent Document 3: JP-A-2003-027194
Patent Document 4: JP-A-H10-130729

SUMMARY OF THE INVENTION

According to the inventors' knowledge, however, there is caused a problem that when the heating rate is made higher, the deviation of the iron loss property resulting from temperature variation inside the steel sheet and defects in an internal oxide layer during the heating becomes large. In the evaluation of iron loss before product shipment is generally used an average of iron loss values over the full width of the steel sheet, so that if the deviation of iron loss is large, the iron loss property in the whole of the steel sheet is evaluated to be low, and hence the desired effect by the rapid heating is not obtained.

The invention is made in view of the above problems inherent to the conventional techniques and is to propose a method for producing a grain-oriented electrical steel sheet, which is lower in the iron loss and smaller in the deviation of iron loss values as compared with those of the conventional techniques.

The inventors have made various studies for solving the above task. As a result, it has been found that when rapid heating is performed in the heating process of the primary recrystallization annealing, the temperature inside the steel sheet can be uniformized to provide the effect by the rapid heating over the full width of the steel sheet by holding the steel sheet in a recovery temperature region for a given time, while <111>//ND orientation is preferentially recovered and the priority of recrystallization is lowered to decrease grains of <111>//ND orientation after the primary recrystallization and increase nuclei of Goss orientation instead to thereby refine recrystallized grains after the secondary recrystallization, whereby a grain-oriented electrical steel sheet being low in the iron loss and small in the deviation of iron loss values can be obtained. It is also found out that the iron loss value can be further decreased by setting $P_{H2O}/P_{H2}$ in an atmosphere in the soaking process causing decarburization reaction to a value lower than that of the conventional art or by dividing the soaking process into plural stages to properly adjust temperature, time and $P_{H2O}/R_{H2}$ in the atmosphere at each of these stages, where $P_{H2O}$ means a Partial water vapor pressure of the atmosphere and $P_{H2}$ means a Partial hydrogen pressure of the atmosphere, and as a result, the invention has been accomplished.

That is, the invention proposes a method for producing a grain-oriented electrical steel sheet by comprising a series of steps of hot rolling a raw steel material comprising C: 0.002-0.10 mass %, Si: 2.0-8.0 mass %, Mn: 0.005-1.0 mass % and the remainder being Fe and inevitable impurities to obtain a hot rolled sheet, subjecting the hot rolled steel sheet to a hot band annealing as required and further to one cold rolling or two or more cold rollings including an intermediate annealing therebetween to obtain a cold rolled sheet having a final sheet thickness, subjecting the cold rolled sheet to primary recrystallization annealing combined with decarburization annealing, applying an annealing separator to the steel sheet surface and then subjecting to final annealing, characterized in that rapid heating is performed at a rate of not less than 50° C./s in a region of 200-700° C. in the heating process of the primary recrystallization annealing, and the steel sheet is held at any temperature of 250-600° C. in the above region for 1-10 seconds, while a soaking process of the primary recrystallization annealing is controlled to a temperature range of 750-900° C., a time of 90-180 seconds and $P_{H2O}/P_{H2}$ in an atmosphere of 0.25-0.40.

The method for producing a grain-oriented electrical steel sheet according to an embodiment of the invention is characterized in that the soaking process of the primary recrystallization annealing is divided into N stages (N: an integer of not less than 2), and the process from the first stage to (N−1) stage is controlled to a temperature of 750-900° C., a time of 80-170 seconds and $P_{H2O}/P_{H2}$ in an atmosphere of 0.25-0.40, and the process of the final N stage is further controlled to a temperature of 750-900° C., a time of 10-60 seconds and $P_{H2O}/P_{H2}$ in an atmosphere of not more than 0.20.

Also, the method for producing a grain-oriented electrical steel sheet according to an embodiment of the invention is characterized in that the soaking process of the primary recrystallization annealing is divided into N stages (N: an integer of not less than 2), the first stage is controlled to a temperature of 820-900° C., a time of 10-60 seconds and $P_{H2O}/P_{H2}$ in an atmosphere of 0.25-0.40, and the second and later stages are controlled to a temperature of 750-900° C., a time of 80-170 seconds and $P_{H2O}/P_{H2}$ in an atmosphere of 0.25-0.40, provided that the temperature of the first stage is higher than those of the second and later stages.

Further, the method for producing a grain-oriented electrical steel sheet according to an embodiment of the invention is characterized in that the soaking process of the primary recrystallization annealing is divided into N stages (N: an integer of not less than 3), and the first stage is controlled to a temperature of 820-900° C., a time of 10-60 seconds and $P_{H2O}/P_{H2}$ in an atmosphere of 0.25-0.40, and the second to (N−1) stages are controlled to a temperature of 750-900° C., a time of 70-160 seconds and $P_{H2O}/P_{H2}$ in an atmosphere of 0.25-0.40, and the last N stage is controlled to a temperature of 750-900° C., a time of 10-60 seconds and $P_{H2O}/P_{H2}$ in an atmosphere of not more than 0.20, provided that the temperature of the first stage is higher than those of the second stage to the N−1 stage.

The raw steel material in the method for producing a grain-oriented electrical steel sheet according to an embodiment of the invention is characterized by containing Al: 0.010-0.050 mass % and N: 0.003-0.020 mass %, or Al: 0.010-0.050 mass %, N: 0.003-0.020 mass %, Se: 0.003-0.030 mass % and/or S: 0.002-0.03 mass % in addition to the above chemical composition.

The method for producing a grain-oriented electrical steel sheet according to an embodiment of the invention is characterized in that the steel sheet is subjected to nitriding treatment on the way of or after the primary recrystallization annealing to increase nitrogen content in the steel sheet to 50-1000 massppm.

The raw steel material in the method for producing a grain-oriented electrical steel sheet according to an embodiment of the invention is characterized by further containing one or more selected from Ni: 0.010-1.50 mass %, Cr: 0.01-0.50 mass %, Cu: 0.01-0.50 mass %, P: 0.005-0.50 mass %, Sb: 0.005-0.50 mass %, Sn: 0.005-0.50 mass %, Bi: 0.005-0.50 mass %, Mo: 0.005-0.10 mass %, B: 0.0002-0.0025 mass %, Te: 0.0005-0.010 mass %, Nb: 0.0010-0.010 mass %, V: 0.001-0.010 mass % and Ta: 0.001-0.010 mass % in addition to the above chemical composition.

According to the invention, it is made possible to stably provide grain-oriented electrical steel sheets being low in the iron loss and small in the deviation of iron loss values by holding the steel sheet in a temperature region causing the recovery for a given time and properly adjusting conditions in the soaking process of the primary recrystallization annealing for causing the decarburization reaction when the rapid heating is performed in the heating process of the primary recrystallization annealing.

DETAILED DESCRIPTION OF EMBODIMENTS OF THE INVENTION

Experiments building a momentum for developing the invention will be described below.

Experiment 1

A steel containing C: 0.065 mass %, Si: 3.44 mass % and Mn: 0.08 mass % is melted to produce a steel slab by a continuous casting method, which is reheated to a temperature of 1250° C. and hot rolled to obtain a hot rolled sheet of 2.4 mm in thickness. The hot rolled sheet is subjected to a hot band annealing at 1050° C. for 60 seconds and subsequently to a primary cold rolling to an intermediate thickness of 1.8 mm, and thereafter the sheet is subjected to an intermediate annealing at 1120° C. for 80 seconds and then warm-rolled at a sheet temperature of 200° C. to obtain a cold rolled sheet having a final sheet thickness of 0.27 mm.

Figure 1:
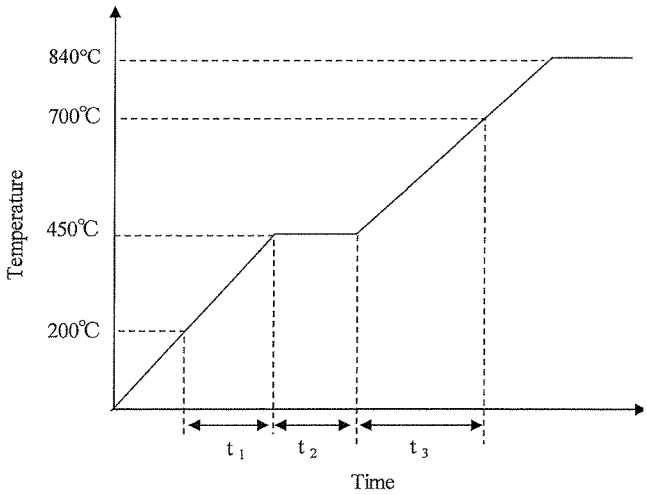
FIG. 1 is a view illustrating a heating pattern in a heating process of a primary recrystallization annealing according to an embodiment of the invention.

Next, the cold rolled sheet is subjected to a primary recrystallization annealing combined with decarburization annealing by varying $P_{H2O}/P_{H2}$ in a wet atmosphere of 50 vol % $H_2$-50 vol % $N_2$ with holding the sheet at 840° C. for 80 seconds. The primary recrystallization annealing is performed by setting a heating rate from 200° C. to 700° C. in the heating process up to 840° C. to 100° C./s and further holding the sheet at 450° C. for 0-30 seconds on the way of the heating. Here, the heating rate of 100° C./s means an average heating rate ((700-200)/($t_1$+$t_3$)) at times $t_1$ and $t_3$ obtained by subtracting a holding time $t_2$ from a time reaching from 200° C. to 700° C. as shown in FIG. 1 (the same hereinafter). The steel sheet after the primary recrystallization annealing is coated with an annealing separator composed mainly of MgO, dried and subjected to final annealing including a secondary recrystallization annealing and a purification treatment of 1200° C.×7 hours in a hydrogen atmosphere to obtain a product sheet.

From each of the product sheets thus obtained are cut out 10 specimens with 100 mm in width and 400 mm in length in the widthwise direction of the steel sheet, and their iron losses $W_{17/50}$ are measured by the method described in JIS C2556 and an average value thereof is determined. According to the iron loss evaluation can be evaluated the iron loss including the deviation because the average value is deteriorated if the deviation of iron loss is existent in the widthwise direction.

Figure 2:
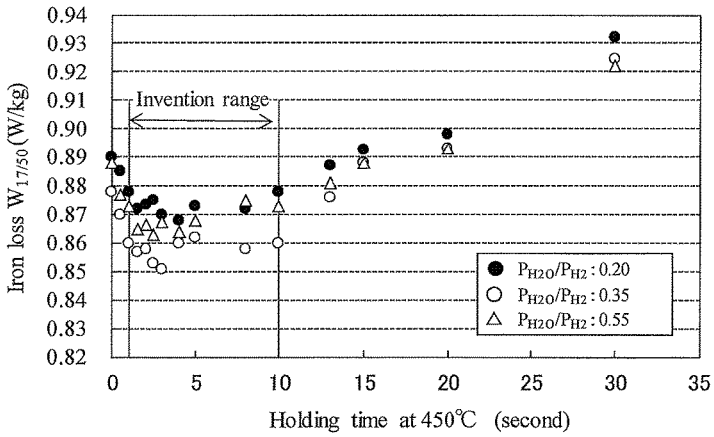
FIG. 2 is a graph showing an influence of a holding time on the way of heating in a primary recrystallization annealing and $P_{H2O}/P_{H2}$ in the atmosphere during soaking process upon iron loss $W_{17/50}$.

The results are shown in FIG. 2 as a relation between the holding time at 450° C. and the iron loss $W_{17/50}$. As seen from this figure, the iron loss is reduced when the holding time is in a range of 1-10 seconds on the way of the heating. This tendency is the same irrespective of the atmosphere condition in the soaking process, but is largest when $P_{H2O}/P_{H2}$ is 0.35.

Experiment 2

The cold rolled sheet obtained in Experiment 1 and having a final thickness of 0.27 mm is subjected to a primary recrystallization annealing combined with decarburization annealing wherein the sheet is held at any temperature within a temperature region of 200-700° C. in the heating process for 2 seconds. Moreover, the soaking process of the primary recrystallization annealing is performed under the following three conditions:

1) a uniform condition that the soaking is conducted at 850° C. for 150 seconds with $P_{H2O}/P_{H2}$ of 0.35.

2) a low dew point condition at later stage that the soaking process is divided into a former stage and a later stage and the former stage is conducted at 850° C. for 120 seconds with $P_{H2O}/P_{H2}$ of 0.35 and the later stage is conducted at 860° C. for 30 seconds with $P_{H2O}/P_{H2}$ of 0.10.

3) a high temperature condition at former stage that the soaking process is divided into a former stage and a later stage and the former stage is conducted at 860° C. for 30 seconds with $P_{H2O}/P_{H2}$ of 0.35 and the later stage is conducted at 850° C. for 120 seconds with $P_{H2O}/P_{H2}$ of 0.35.

Then, the steel sheet subjected to the primary recrystallization annealing is coated with an annealing separator composed mainly of MgO, dried and subjected to final annealing including a secondary recrystallization annealing and a purification treatment of 1200° C.×7 hours in a hydrogen atmosphere to obtain a product sheet.

Figure 3:
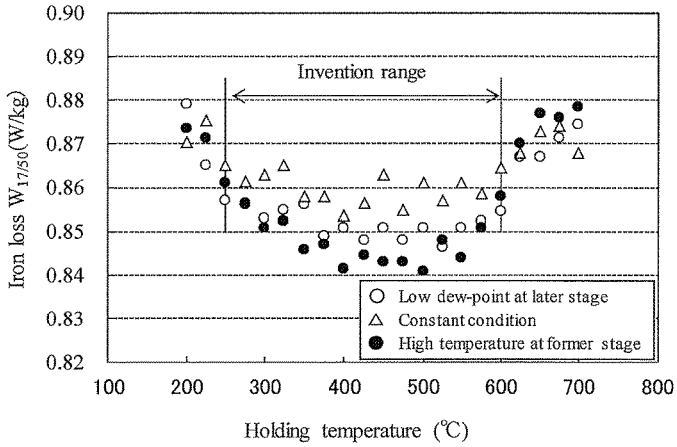
FIG. 3 is a graph showing an influence of a holding temperature on the way of heating in a primary recrystallization annealing and processing conditions of soaking process upon iron loss $W_{17/50}$.

A specimen is cut out from the product sheet thus obtained as in Experiment 1 to determine an iron loss $W_{17/50}$ by the method described in JIS C2556. The measured results are shown in FIG. 3 as a relation between the holding temperature in the heating process and the iron loss $W_{17/50}$. As seen from this figure, the iron loss is reduced when the holding temperature on the way of the rapid heating is in a range of 250-600° C. irrespective of the conditions in the soaking process. Moreover, it can be seen that the effect of reducing the iron loss is obtained by making a dew-point at the later stage lower than that at the former stage or by making a temperature at the former stage higher than that at the later stage as compared to the case that the conditions of the soaking process are constant over the whole thereof.

Although the reason why the iron loss is improved by conducting a holding treatment for holding at a suitable temperature for a suitable time in the rapid heating process of the primary recrystallization annealing and properly adjusting the decarburization conditions in the soaking process as seen from the results in Experiments 1 and 2 is not clear sufficiently, the inventors think as follows.

The rapid heating treatment has an effect of suppressing the development of <111>//ND orientation in the recrystallization texture as previously mentioned. In general, a great deal of strain is introduced into <111>//ND orientation during the cold rolling, so that the strain energy stored is higher than those in the other orientations. Therefore, when the primary recrystallization annealing is performed at a usual heating rate, the recrystallization is preferentially caused from the rolled texture of <111>//ND orientation having a high stored strain energy. Since grains of <111>//ND orientation are usually generated from the rolled texture of <111>//ND orientation in the recrystallization, a main orientation of the texture after the recrystallization is <111>//ND orientation.

However, when the rapid heating is performed, a greater amount of heat energy is applied as compared to the energy released by recrystallization, so that the recrystallization may be caused even in other orientations having a relatively low stored strain energy, whereby the grains of <111>//ND orientation after the recrystallization are relatively decreased to improve the magnetic properties. This is a reason for performing the rapid heating in the conventional techniques.

When a holding treatment by holding at a temperature causing the recovery for a given time is performed on the way of the rapid heating, the <111>//ND orientation having a high strain energy preferentially causes the recovery. Therefore, the driving force causing the recrystallization of <111>//ND orientation resulted from the rolled texture of <111>//ND orientation is decreased selectively, and hence the recrystallization may be caused even in other orientations. As a result, the <1114/ND orientation after the recrystallization is relatively decreased further.

However, when the holding time exceeds 10 seconds, the recovery is caused over a wide range and hence the recovered microstructure remains as it is without recrystallization to form a microstructure different from the above desired primary recrystallized microstructure. As a result, it is thought to largely exert a bad influence on the secondary recrystallization, leading to the deterioration of the iron loss property.

According to the above thinking, it is considered that the improvement of magnetic properties by holding at a temperature causing the recovery for a short time on the way of the heating is limited to a case that the heating rate is faster than the heating rate (10-20° C./s) using the conventional radiant tube or the like, concretely the heating rate is not less than 50° C./s. In the invention, therefore, the heating rate within a temperature region of 200-700° C. in the primary recrystallization annealing is preferably defined to not less than 50° C./s.

Moreover, the magnetic properties are greatly influenced by the temperature, time and atmosphere in the soaking process advancing the decarburization reaction. This is considered due to the fact that the configuration in an internal oxide layer formed below the steel sheet surface is modified by the rapid heating. Namely, in the case of the usual heating rate, internal oxidation starts to progress on the way of heating before the completion of the primary recrystallization, and a network-like structure of $SiO_2$ is formed in dislocation or sub-boundary, whereby a dense internal oxide layer is formed. On the other hand, when the rapid heating is performed, the internal oxidation starts after the completion of the primary recrystallization. For this reason, the network-like structure of $SiO_2$ is not formed in the dislocation or sub-boundary, and a non-uniform internal oxide layer is formed instead. Since this internal oxide layer is low in the function of protecting the steel sheet against the atmosphere in the final annealing, when an inhibitor is used, the inhibitor is oxidized in the final annealing to diminish the effect of improving the magnetic properties by the rapid heating. While when the inhibitor is not used, the formation of precipitates such as oxide and the like is caused in the final annealing to deteriorate the orientation of the secondary recrystallization.

In order to solve these problems, it is considered that it is effective to decrease oxidation potential of the atmosphere in the soaking process causing the decarburization reaction. That is, the diffusion of oxygen into the inside of the steel sheet is suppressed in the decarburization annealing and the diffusion of Si in the steel onto the surface is relatively enhanced by decreasing the oxidation potential of the atmosphere to form a dense layer of $SiO_2$. This layer functions as a shielding material for suppressing oxidation of the inhibitor or excessive precipitation of oxide in the final annealing to thereby prevent the deterioration of the magnetic properties.

Further, it is also effective to divide the soaking process advancing the decarburization into plural stages and decrease oxidation potential of the atmosphere before the end of the soaking or increase the temperature at the start of the soaking. When oxidation potential of the atmosphere before the end of the soaking is decreased, oxygen supply is discontinued at this point and the configuration of the resulting $SiO_2$ is modified into a lamella form to bring about an effect of enhancing shielding property of the atmosphere in the final annealing. While when the temperature at the start of the soaking is increased, the internal oxide layer is formed at an early stage of the soaking as a barrier to suppress subsequent oxidation, whereby the diffusion of Si onto the surface is relatively increased to bring about an effect of forming a dense internal oxide layer, which is effective for the improvement of iron loss.

There will be described a chemical composition of a raw steel material (slab) applied to the grain-oriented electrical steel sheet according to embodiments of the invention.

C: 0.002-0.10 mass %

When C content is less than 0.002 mass %, the effect of reinforcing grain boundary through C is lost to cause troubles in the production such as slab cracking and the like. While when it exceeds 0.10 mass %, it is difficult to decrease C content by the decarburization annealing to not more than 0.005 mass % causing no magnetic aging. Therefore, the C content is in a range of 0.002-0.10 mass %. Preferably, it is in a range of 0.010-0.080 mass %.

Si: 2.0-8.0 mass %

Si is an element required for enhancing a specific resistance of steel to reduce the iron loss. When the content is less than 2.0 mass %, the above effect is not sufficient, while when it exceeds 8.0 mass %, the workability is deteriorated and it is difficult to produce the sheet by rolling. Therefore, the Si content is in a range of 2.0-8.0 mass %. Preferably, it is in a range of 2.5-4.5 mass %.

Mn: 0.005-1.0 mass %

Mn is an element required for improving hot workability of steel. When the content is less than 0.005 mass %, the above effect is not sufficient, while when it exceeds 1.0 mass %, a magnetic flux density of a product sheet is lowered. Therefore, the Mn content is in a range of 0.005-1.0 mass %. Preferably, it is in a range of 0.02-0.20 mass %.

As to ingredients other than C, Si and Mn, in order to cause the secondary recrystallization, they are classified into a case using an inhibitor and a case using no inhibitor.

At first, when an inhibitor is used for causing the secondary recrystallization, for example, when an AlN-based inhibitor is used, Al and N are preferable to be contained in amounts of Al: 0.010-0.050 mass % and N: 0.003-0.020 mass %, respectively. When a MnS/MnSe-based inhibitor is used, it is preferable to contain the aforementioned amount of Mn and S: 0.002-0.030 mass % and/or Se: 0.003-0.030 mass %. When the addition amount of each of the respective elements is less than the lower limit, the inhibitor effect is not obtained sufficiently, while when it exceeds the upper limit, the inhibitor ingredients are retained as a non-solid solute state during the heating of the slab and hence the inhibitor effect is decreased and the satisfactory magnetic properties are not obtained. Moreover, the AlN-based inhibitor and the MnS/MnSe-based inhibitor may be used together.

On the other hand, when an inhibitor is not used for causing the secondary recrystallization, the contents of Al, N, S and Se mentioned above as an inhibitor forming ingredient are decreased as much as possible, and it is preferable to use a raw steel material containing Al: less than 0.01 mass %, N: less than 0.0050 mass %, S: less than 0.0050 mass % and Se: less than 0.0030 mass %.

The remainder other than the above ingredients in the raw steel material used in the grain-oriented electrical steel sheet according to an embodiment of the invention is Fe and inevitable impurities.

However, one or more selected from Ni: 0.010-1.50 mass %, Cr: 0.01-0.50 mass %, Cu: 0.01-0.50 mass %, P: 0.005-0.50 mass %, Sb: 0.005-0.50 mass %, Sn: 0.005-0.50 mass %, Bi: 0.005-0.50 mass %, Mo: 0.005-0.10 mass %, B: 0.0002-0.0025 mass %, Te: 0.0005-0.010 mass %, Nb: 0.0010-0.010 mass %, V: 0.001-0.010 mass % and Ta: 0.001-0.010 mass % may be added properly for the purpose of improving the magnetic properties.

The method for producing the grain-oriented electrical steel sheet according to embodiments of the invention will be described below.

A steel having the aforementioned chemical composition is melted by a usual refining process and then may be shaped into a raw steel material (slab) by the conventionally well-known ingot making-blooming method or continuous casting method, or may be shaped into a thin cast slab having a thickness of not more than 100 mm by a direct casting method. The slab is reheated according to the usual manner, for example, to a temperature of about 1400° C. in the case of containing the inhibitor ingredients or to a temperature of not higher than 1250° C. in the case of containing no inhibitor ingredient and then subjected to hot rolling. Moreover, when the inhibitor ingredients are not contained, the slab may be subjected to hot rolling without reheating immediately after the casting. Also, the thin cast slab may be forwarded to subsequent steps with the omission of the hot rolling.

Then, the hot rolled sheet obtained by hot rolling may be subjected to a hot band annealing, if necessary. The temperature of the hot band annealing is preferable to be in a range of 800-1150° C. for providing good magnetic properties. When it is lower than 800° C., a band structure formed by the hot rolling is retained, and hence it is difficult to obtain primary recrystallized structure of uniformly sized grains and the growth of the secondary recrystallized grains is obstructed. While when it exceeds 1150° C., the grain size after the hot band annealing becomes excessively coarsened, and hence it is also difficult to obtain primary recrystallized structure of uniformly sized grains. The more preferable temperature of the hot band annealing is in a range of 900-1100° C.

The steel sheet after the hot rolling or after the hot band annealing is subjected to a single cold rolling or two or more cold rollings including an intermediate annealing therebetween to obtain a cold rolled sheet having a final thickness. The annealing temperature of the intermediate annealing is preferable to be in a range of 900-1200° C. When it is lower than 900° C., the recrystallized grains after the intermediate annealing become finer and further Goss nuclei in the primary recrystallized structure tend to be decreased to deteriorate magnetic properties of a product sheet. While when it exceeds 1200° C., the crystal grains become excessively coarsened in a similar fashion as in the hot band annealing, and it is difficult to obtain primary recrystallized structure of uniformly sized grains. The more preferable temperature of the intermediate annealing is in a range of 950-1150° C.

Moreover, in the cold rolling for providing the final thickness (final cold rolling), it is effective to perform warm rolling by raising the steel sheet temperature to 100-300° C. or conduct one or more aging treatments at a temperature of 100-300° C. on the way of the cold rolling for improving the primary recrystallized texture to improve the magnetic properties.

Thereafter, the cold rolled sheet having a final thickness is subjected to primary recrystallization annealing combined with decarburization annealing.

In embodiments of the invention, it is advantageous to perform rapid heating at a rate of not less than 50° C./s in a region of 200-700° C. in the heating process of the primary recrystallization annealing and to hold at any temperature of 250-600° C. for 1-10 seconds. The heating rate in the region of 200-700° C. (not less than 50° C./s) is an average heating rate in times except for the holding time as previously mentioned. When the holding temperature is lower than 250° C., the recovery of the texture is not sufficient, while when it exceeds 600° C., the recovery proceeds too much. Further, when the holding time is less than 1 second, the effect of the holding treatment is small, while when it exceeds 10 seconds, the recovery proceeds too much. Moreover, the preferable temperature of the holding treatment is any temperature of 350-500° C., and the preferable holding time is in a range of 1-5 seconds. Also, the preferable heating rate in the region of 200° C.-700° C. in the heating process is not less than 70° C./s. The upper limit of the heating rate is preferable to be approximately 400° C./s from the viewpoint of equipment cost and production cost.

Also, the holding treatment from 250 to 600° C. may be conducted at any temperature of the above temperature range, but the temperature is not necessarily constant. When the temperature change is within ±10° C./s, the effect similar to the holding case can be obtained, so that the temperature may be increased or decreased within a range of ±10° C./s. The atmosphere $P_{H2O}/P_{H2}$ in the heating process is not particularly limited.

As conditions in the subsequent soaking process of the primary recrystallization annealing, when the grain size of the primary recrystallized grains is set to a specific range or when C content of the raw material is more than 0.005 mass %, it is necessary that the annealing temperature is in a range of 750-900° C., the soaking time is in a range of 90-180 seconds and $P_{H2O}/P_{H2}$ of the atmosphere is in a range of 0.25-0.40 from a viewpoint of sufficient decarburization reaction. When the annealing temperature is lower than 750° C., the grain size of the primary recrystallized grains is too small or the decarburization reaction is not sufficiently advanced, while when it exceeds 900° C., the grain size of the primary recrystallized grains becomes too large. When the soaking time is less than 90 seconds, the total amount of internal oxide is small, while when it is too long exceeding 180 seconds, internal oxidation is excessively promoted to rather deteriorate the magnetic properties. When $P_{H2O}/P_{H2}$ of the atmosphere is less than 0.25, it causes poor decarburization, while when it exceeds 0.40, a coarse internal oxide layer is formed to deteriorate the magnetic properties. The preferable soaking temperature of the primary recrystallization annealing is in a range of 780-880° C. and the preferable soaking time is in a range of 100-160 seconds. Also, the preferable $P_{H2O}/P_{H2}$ of the atmosphere in the primary recrystallization annealing is in a range of 0.30-0.40.

Moreover, the soaking process conducting decarburization reaction may be divided into plural N stages (N is an integer of not less than 2). In this case, it is effective to make $P_{H2O}/P_{H2}$ of the final N stage to not more than 0.2 for improving the deviation in the magnetic properties. When $P_{H2O}/P_{H2}$ exceeds 0.20, the effect of reducing the deviation is not obtained sufficiently. Moreover, the lower limit is not particularly limited. Further, the treating time of the final N stage is preferable to be in a range of 10-60 seconds. When it is less than 10 seconds, the effect is not sufficient, while when it exceeds 60 seconds, the growth of the primary recrystallized grains is excessively promoted to deteriorate the magnetic properties. The more preferable $P_{H2O}/P_{H2}$ of the N step is not more than 0.15, and the more preferable treating time is in a range of 20-40 seconds. The temperature before the end of the soaking process may be appropriately changed in a range of 750-900° C. as the soaking temperature according to the invention.

When the soaking process conducting decarburization reaction is divided into plural N stages (N is an integer of not less than 2), it is preferable that the temperature of the first stage is made higher than those of the subsequent stages, or the temperature of the first stage is set to 820-900° C. and the temperatures of the second and later stages are not less than the soaking temperature. Increasing the temperature of the first stage is effective for improving the magnetic properties since an internal oxide layer formed at an early stage forms a dense internal oxide layer while suppressing subsequent oxidation. The treating time of the first stage is preferable to be in a range of 10-60 seconds. When it is less than 10 seconds, the effect is not sufficient, while when it exceeds 60 seconds, the internal oxidation is excessively promoted to rather deteriorate the magnetic properties. The more preferable temperature of the first stage is in a range of 840-880° C. and the more preferable treating time is in a range of 10-40 seconds. The atmosphere of this stage may be the same as the soaking atmosphere of subsequent stages, but can be changed within the range of $P_{H2O}/P_{H2}$ according to the invention.

It is also effective to divide the soaking process conducting decarburization reaction into not less than three stages, wherein the soaking temperature is increased at the first stage and at the same time $P_{H2O}/P_{H2}$ is decreased at the final N stage, whereby the effect of improving the magnetic properties can be more expected.

Moreover, it is effective to increase N content in steel by conducting nitriding treatment on the way of or after the primary recrystallization annealing for improving the magnetic properties, since an inhibitor effect (preventive force) by AlN or $Si_3N_4$ is further reinforced. The N content to be increased is preferable to be in a range of 50-1000 massppm. When it is less than 50 massppm, the effect by the nitriding treatment is small, while when it exceeds 1000 massppm, the preventive force becomes too large and poor second recrystallization is caused. The increased N content is more preferably in a range of 200-800 massppm.

The steel sheet subjected to the primary recrystallization annealing is then coated on its surface with an annealing separator composed mainly of MgO, dried, and subjected to final annealing, whereby a secondary recrystallized texture highly accumulated in Goss orientation is developed and a forsterite coating is formed and purification is enhanced. The temperature of the final annealing is preferable to be not lower than 800° C. for generating the secondary recrystallization and to be about 1100° C. for completing the secondary recrystallization. Moreover, it is preferable to continue heating up to a temperature of approximately 1200° C. in order to form the forsterite coating and to enhance purification.

The steel sheet after the final annealing is then subjected to washing with water, brushing, pickling or the like for removing the unreacted annealing separator attached to the surface of the steel sheet, and thereafter subjected to a flattening annealing to conduct shape correction, which is effective for reducing the iron loss. This is due to the fact that since the final annealing is usually performed in a coiled state, a wound habit is applied to the sheet and may deteriorate the properties in the measurement of the iron loss.

Further, if the steel sheets are used with a laminated state, it is effective to apply an insulation coating onto the surface of the steel sheet in the flattening annealing or before or after the flattening annealing. Especially, it is preferable to apply a tension-imparting coating to the steel sheet as the insulation coating for the purpose of reducing the iron loss. In the formation of the tension-imparting coating, it is more preferable to adopt a method of applying the tension coating through a binder or a method of depositing an inorganic matter onto a surface layer of the steel sheet through a physical vapor deposition or a chemical vapor deposition process because these methods can form an insulation coating having an excellent adhesion property and a considerably large effect of reducing the iron loss.

In order to further reduce the iron loss, it is preferable to conduct magnetic domain refining treatment. As such a treating method can be used a method of forming grooves in a final product sheet as being generally performed, a method of introducing linear or dotted heat strain or impact strain through laser irradiation, electron beam irradiation or plasma irradiation, a method of forming grooves in a surface of a steel sheet cold rolled to a final thickness or a steel sheet of an intermediate step through etching.

Example 1

A steel slab comprising C: 0.070 mass %, Si: 3.35 mass %, Mn: 0.10 mass %, Al: 0.025 mass %, Se: 0.025 mass %, N: 0.012 mass % and the remainder being Fe and inevitable impurities is manufactured by a continuous casting method, reheated to a temperature of 1420° C., and then hot rolled to obtain a hot rolled sheet of 2.4 mm in thickness. The hot rolled sheet is subjected to a hot band annealing at 1000° C. for 50 seconds, a first cold rolling to provide an intermediate thickness of 1.8 mm, an intermediate annealing at 1100° C. for 20 seconds and then a second cold rolling to obtain a cold rolled sheet having a final thickness of 0.27 mm, which is subjected to a primary recrystallization annealing combined with decarburization annealing. In the primary recrystallization annealing, the following items 1)-3) are varied as shown in Tables 1-1 and 1-2:

1) Heating rate from 200° C. to 700° C. in the heating process;

2) Presence or absence of a holding treatment on the way of heating in the heating process and a temperature and a time thereof;

3) Temperature, time and $P_{H2O}/P_{H2}$ of an atmosphere in each stage when the soaking process is divided into three stages.

TABLE 1-1

| | Heating process | | | | Soaking process | | | | | | | | | | | |
|---|---|---|---|---|---|---|---|---|---|---|---|---|---|---|---|---|
| | | | | | First stage | | | Second stage | | | Third stage | | | | | |
| No. | Heating rate from 200° C. to 700° C. (° C./s) | Presence or absence of holding treatment | Holding temperature (° C.) | Holding time (s) | Temperature (° C.) | Time (s) | Atmosphere $P_{H2O}/P_{H2}$ | Temperature (° C.) | Time (s) | Atmosphere $P_{H2O}/P_{H2}$ | Temperature (° C.) | Time (s) | Atmosphere $P_{H2O}/P_{H2}$ | Total time of the first to the third stage (s) | Iron loss $W_{17/50}$ (W/kg) | Remarks |
| 1 | 45 | Presence | 400 | 5.0 | 820 | | 0.35 | 820 | | 0.35 | 820 | | 0.35 | 120 | 0.915 | Comparative Example |
| 2 | 50 | Presence | 400 | 5.0 | 820 | | 0.35 | 820 | | 0.35 | 820 | | 0.35 | 120 | 0.858 | Invention Example |
| 3 | 55 | Presence | 400 | 5.0 | 820 | | 0.35 | 820 | | 0.35 | 820 | | 0.35 | 120 | 0.854 | Invention Example |
| 4 | 80 | Presence | 400 | 5.0 | 820 | | 0.35 | 820 | | 0.35 | 820 | | 0.35 | 120 | 0.848 | Invention Example |
| 5 | 80 | Absence | — | — | 820 | | 0.35 | 820 | | 0.35 | 820 | | 0.35 | 120 | 0.903 | Comparative Example |
| 6 | 80 | Presence | 200 | 5.0 | 820 | | 0.35 | 820 | | 0.35 | 820 | | 0.35 | 120 | 0.895 | Comparative Example |
| 7 | 80 | Presence | 250 | 5.0 | 820 | | 0.35 | 820 | | 0.35 | 820 | | 0.35 | 120 | 0.860 | Invention Example |
| 8 | 80 | Presence | 300 | 5.0 | 820 | | 0.35 | 820 | | 0.35 | 820 | | 0.35 | 120 | 0.853 | Invention Example |
| 9 | 80 | Presence | 600 | 5.0 | 820 | | 0.35 | 820 | | 0.35 | 820 | | 0.35 | 120 | 0.854 | Invention Example |
| 10 | 80 | Presence | 650 | 5.0 | 820 | | 0.35 | 820 | | 0.35 | 820 | | 0.35 | 120 | 0.964 | Comparative Example |
| 11 | 80 | Presence | 400 | 0.5 | 820 | | 0.35 | 820 | | 0.35 | 820 | | 0.35 | 120 | 0.878 | Comparative Example |

TABLE 1-1-continued

| | Heating process | | | | Soaking process | | | | | | | | | | | |
|---|---|---|---|---|---|---|---|---|---|---|---|---|---|---|---|---|
| | Heating rate from 200° C. to 700° C. (° C./s) | Presence or absence of holding treatment | Holding temperature (° C.) | Holding time (s) | First stage Temperature (° C.) | First stage Time (s) | First stage Atmosphere $P_{H2O}/P_{H2}$ | Second stage Temperature (° C.) | Second stage Time (s) | Second stage Atmosphere $P_{H2O}/P_{H2}$ | Third stage Temperature (° C.) | Third stage Time (s) | Third stage Atmosphere $P_{H2O}/P_{H2}$ | Total time of the first to the third stage (s) | Iron loss $W_{17/50}$ (W/kg) | Remarks |
| No. | | | | | | | | | | | | | | | | |
| 12 | 80 | Presence | 400 | 1.0 | 820 | | 0.35 | 820 | | 0.35 | 820 | | 0.35 | 120 | 0.852 | Invention Example |
| 13 | 80 | Presence | 400 | 2.0 | 820 | | 0.35 | 820 | | 0.35 | 820 | | 0.35 | 120 | 0.843 | Invention Example |
| 14 | 80 | Presence | 400 | 10.0 | 820 | | 0.35 | 820 | | 0.35 | 820 | | 0.35 | 120 | 0.845 | Invention Example |
| 15 | 80 | Presence | 400 | 15.0 | 820 | | 0.35 | 820 | | 0.35 | 820 | | 0.35 | 120 | 0.913 | Comparative Example |
| 16 | 80 | Presence | 400 | 5.0 | 730 | | 0.35 | 730 | | 0.35 | 730 | | 0.35 | 120 | 0.886 | Comparative Example |
| 17 | 80 | Presence | 400 | 5.0 | 750 | | 0.35 | 750 | | 0.35 | 750 | | 0.35 | 120 | 0.857 | Invention Example |
| 18 | 80 | Presence | 400 | 5.0 | 800 | | 0.35 | 800 | | 0.35 | 800 | | 0.35 | 120 | 0.851 | Invention Example |
| 19 | 80 | Presence | 400 | 5.0 | 900 | | 0.35 | 900 | | 0.35 | 900 | | 0.35 | 120 | 0.855 | Invention Example |
| 20 | 80 | Presence | 400 | 5.0 | 920 | | 0.35 | 920 | | 0.35 | 920 | | 0.35 | 120 | 0.982 | Comparative Example |
| 21 | 80 | Presence | 400 | 5.0 | 820 | | 0.35 | 820 | | 0.35 | 820 | | 0.35 | 160 | 0.852 | Invention Example |
| 22 | 80 | Presence | 400 | 5.0 | 820 | | 0.35 | 820 | | 0.35 | 820 | | 0.35 | 180 | 0.856 | Invention Example |
| 23 | 80 | Presence | 400 | 5.0 | 820 | | 0.35 | 820 | | 0.35 | 820 | | 0.35 | 200 | 0.905 | Comparative Example |

TABLE 1-2

| | Heating process | | | | Soaking process | | | | | | | | | | | |
|---|---|---|---|---|---|---|---|---|---|---|---|---|---|---|---|---|
| | Heating rate from 200° C. to 700° C. (° C./s) | Presence or absence of holding treatment | Holding temperature (° C.) | Holding time (s) | First stage Temperature (° C.) | First stage Time (s) | First stage Atmosphere $P_{H2O}/P_{H2}$ | Second stage Temperature (° C.) | Second stage Time (s) | Second stage Atmosphere $P_{H2O}/P_{H2}$ | Third stage Temperature (° C.) | Third stage Time (s) | Third stage Atmosphere $P_{H2O}/P_{H2}$ | Total time of the first to the third stage (s) | Iron loss $W_{17/50}$ (W/kg) | Remarks |
| No. | | | | | | | | | | | | | | | | |
| 24 | 80 | Presence | 400 | 5.0 | 820 | | 0.20 | 820 | | 0.20 | 820 | | 0.20 | 120 | 0.940 | Comparative Example |
| 25 | 80 | Presence | 400 | 5.0 | 820 | | 0.25 | 820 | | 0.25 | 820 | | 0.25 | 120 | 0.851 | Invention Example |
| 26 | 80 | Presence | 400 | 5.0 | 820 | | 0.40 | 820 | | 0.40 | 820 | | 0.40 | 120 | 0.846 | Invention Example |
| 27 | 80 | Presence | 400 | 5.0 | 820 | | 0.45 | 820 | | 0.45 | 820 | | 0.45 | 120 | 0.862 | Comparative Example |
| 28 | 80 | Presence | 400 | 5.0 | 820 | | 0.50 | 820 | | 0.50 | 820 | | 0.50 | 120 | 0.871 | Comparative Example |
| 29 | 80 | Presence | 400 | 5.0 | 820 | | 0.55 | 820 | | 0.55 | 820 | | 0.55 | 120 | 0.882 | Comparative Example |
| 30 | 80 | Presence | 400 | 5.0 | 780 | 30 | 0.35 | 820 | | 0.35 | 820 | | 0.35 | 150 | 0.861 | Invention Example |
| 31 | 80 | Presence | 400 | 5.0 | 800 | 30 | 0.35 | 820 | | 0.35 | 820 | | 0.35 | 150 | 0.859 | Invention Example |
| 32 | 80 | Presence | 400 | 5.0 | 830 | 30 | 0.35 | 820 | | 0.35 | 820 | | 0.35 | 150 | 0.839 | Invention Example |
| 33 | 80 | Presence | 400 | 5.0 | 850 | 30 | 0.35 | 820 | | 0.35 | 820 | | 0.35 | 150 | 0.811 | Invention Example |
| 34 | 80 | Presence | 400 | 5.0 | 900 | 30 | 0.35 | 820 | | 0.35 | 820 | | 0.35 | 150 | 0.818 | Invention Example |
| 35 | 80 | Presence | 400 | 5.0 | 910 | 30 | 0.35 | 820 | | 0.35 | 820 | | 0.35 | 150 | 0.932 | Comparative Example |
| 36 | 80 | Presence | 400 | 5.0 | 840 | 5 | 0.35 | 820 | | 0.35 | 820 | | 0.35 | 125 | 0.846 | Invention Example |
| 37 | 80 | Presence | 400 | 5.0 | 840 | 10 | 0.35 | 820 | | 0.35 | 820 | | 0.35 | 130 | 0.811 | Invention Example |
| 38 | 80 | Presence | 400 | 5.0 | 840 | 60 | 0.35 | 820 | | 0.35 | 820 | | 0.35 | 180 | 0.810 | Invention Example |
| 39 | 80 | Presence | 400 | 5.0 | 840 | 80 | 0.35 | 820 | | 0.35 | 820 | | 0.35 | 200 | 0.893 | Comparative Example |
| 40 | 80 | Presence | 400 | 5.0 | 820 | | 0.35 | 820 | | 0.35 | 820 | 5 | 0.10 | 125 | 0.847 | Invention Example |
| 41 | 80 | Presence | 400 | 5.0 | 820 | | 0.35 | 820 | | 0.35 | 820 | 10 | 0.10 | 130 | 0.826 | Invention Example |
| 42 | 80 | Presence | 400 | 5.0 | 820 | | 0.35 | 820 | | 0.35 | 820 | 60 | 0.10 | 180 | 0.828 | Invention Example |
| 43 | 80 | Presence | 400 | 5.0 | 820 | | 0.35 | 820 | | 0.35 | 820 | 80 | 0.10 | 200 | 0.886 | Comparative Example |
| 44 | 80 | Presence | 400 | 5.0 | 820 | | 0.35 | 820 | | 0.35 | 820 | 30 | 0.20 | 150 | 0.830 | Invention Example |
| 45 | 80 | Presence | 400 | 5.0 | 820 | | 0.35 | 820 | | 0.35 | 820 | 30 | 0.25 | 150 | 0.850 | Invention Example |
| 46 | 80 | Presence | 400 | 5.0 | 840 | 30 | 0.25 | 820 | 120 | 0.35 | 820 | 30 | 0.10 | 180 | 0.789 | Invention Example |
| 47 | 80 | Presence | 400 | 5.0 | 840 | 30 | 0.32 | 820 | 120 | 0.35 | 850 | 30 | 0.10 | 180 | 0.778 | Invention Example |
| 48 | 80 | Presence | 400 | 5.0 | 840 | 30 | 0.40 | 820 | 120 | 0.35 | 880 | 30 | 0.10 | 180 | 0.783 | Invention Example |

Then, the steel sheet after the primary recrystallization annealing is coated on its surface with an annealing separator composed mainly of MgO, dried and subjected to final annealing combined with purification treatment at 1200° C. for 10 hours. The atmosphere gas of the final annealing is $H_2$ in the holding at 1200° C. for the purification treatment, and $N_2$ in the heating and cooling.

From each of the steel sheets obtained after the final annealing are cut out 10 specimens with a width of 100 mm and a thickness of 400 mm in a widthwise direction of the steel sheet, and their iron losses $W_{17750}$ are measured by a method described in JIS C2556 to determine an average value thereof.

The measured results are also shown in Tables 1-1 and 1-2. As seen from these tables, grain-oriented electrical steel sheets having a low iron loss are obtained by applying the invention.

Example 2

A steel slab having a chemical composition shown in No. 1-17 of Table 2 and comprising the remainder being Fe and inevitable impurities is manufactured by a continuous casting method, reheated to a temperature of 1380° C. and hot rolled to obtain a hot rolled sheet of 2.0 mm in thickness. The hot rolled sheet is subjected to a hot band annealing at 1030° C. for 10 seconds and cold rolled to obtain a cold rolled sheet having a final thickness of 0.23 mm. Thereafter, the cold rolled sheet is subjected to a primary recrystallization annealing combined with decarburization annealing. In this case, a heating rate in a region of 200-700° C. of the heating process up to 860° C. is 75° C./s, and a holding treatment is conducted at a temperature of 450° C. for 1.5 seconds on the way of the heating. The subsequent soaking process is divided into three stages, wherein the first stage is performed at 860° C. for 20 seconds with $P_{H2O}/P_{H2}$ of 0.40, and the second stage is performed at 850° C. for 100 seconds with $P_{H2O}/P_{H2}$ of 0.35, and the third stage is conducted at 850° C. for 20 seconds with $P_{H2O}/P_{H2}$ of 0.15.

TABLE 2

| | Chemical composition (mass %) | | | | | | | | Iron loss $W_{17/50}$ | |
|---|---|---|---|---|---|---|---|---|---|---|
| No | C | Si | Mn | Al | N | Se | S | Others | (W/kg) | Remarks |
| 1 | 0.055 | 3.25 | 0.06 | — | — | — | — | — | 0.853 | Invention Example |
| 2 | 0.044 | 3.38 | 0.15 | 0.007 | 0.003 | | 0.002 | — | 0.839 | Invention Example |
| 3 | 0.078 | 3.41 | 0.08 | 0.020 | 0.008 | 0.015 | 0.002 | — | 0.719 | Invention Example |
| 4 | 0.222 | 3.22 | 0.15 | — | — | — | — | — | 1.536 | Comparative Example |
| 5 | 0.052 | 0.85 | 0.16 | — | — | — | — | — | 1.019 | Comparative Example |
| 6 | 0.053 | 3.25 | 1.51 | — | — | — | — | — | 1.016 | Comparative Example |
| 7 | 0.050 | 3.25 | 0.08 | — | — | 0.020 | — | — | 0.850 | Invention Example |
| 8 | 0.040 | 3.25 | 0.07 | — | — | 0.020 | 0.005 | Sb:0.025 | 0.802 | Invention Example |
| 9 | 0.066 | 2.84 | 0.11 | 0.019 | 0.008 | 0.012 | — | Sb:0.022, Cu:0.11, P:0.009 | 0.823 | Invention Example |
| 10 | 0.041 | 3.01 | 0.05 | 0.011 | 0.006 | — | 0.004 | Ni:0.20, Cr:0.05, Sb:0.02, Sn:0.05 | 0.817 | Invention Example |
| 11 | 0.006 | 3.20 | 0.34 | 0.005 | 0.003 | — | — | Bi:0.022, Mo:0.05, B:0.0018 | 0.832 | Invention Example |
| 12 | 0.022 | 2.55 | 0.04 | — | — | — | 0.004 | Te:0.0020, Nb:0.0050 | 0.836 | Invention Example |
| 13 | 0.044 | 3.33 | 0.12 | 0.036 | 0.003 | 0.010 | 0.005 | V:0.005, Ta:0.005 | 0.725 | Invention Example |
| 14 | 0.085 | 3.23 | 0.08 | 0.030 | 0.010 | — | — | P:0.12, Mo:0.08 | 0.723 | Invention Example |
| 15 | 0.150 | 3.41 | 0.11 | 0.015 | 0.007 | 0.014 | 0.003 | — | 1.644 | Comparative Example |
| 16 | 0.045 | 0.18 | 0.22 | — | — | 0.025 | 0.010 | — | 3.527 | Comparative Example |
| 17 | 0.008 | 3.20 | 1.23 | 0.021 | 0.011 | — | — | — | 1.389 | Comparative Example |

Then, the steel sheet after the primary recrystallization annealing is coated on its surface with an annealing separator composed mainly of MgO, dried and subjected to final annealing combined with purification treatment at 1220° C. for 4 hours. The atmosphere gas of the final annealing is $H_2$ in the holding at 1220° C. for the purification treatment, and Ar in the heating and cooling.

From each of the steel sheets obtained after the final annealing are cut out 10 specimens with a width of 100 mm and a length of 400 mm in a widthwise direction of the steel sheet, and their iron losses $W_{17/50}$ are measured by a method described in JIS C2556 to determine an average value thereof.

The measured results are also shown in Table 2. As seen from this table, grain-oriented electrical steel sheets having a low iron loss are obtained by applying the invention.

The technique of the invention can control the texture of the cold rolled steel sheet and is applicable to the control of the texture in not only the grain oriented electrical steel sheets, but also the non-oriented electrical steel sheets, the cold rolled steel sheets requiring deep drawability such as steel sheet for automobiles or the like, the steel sheets subjected to surface treatment and so on.

The invention claimed is:

1. A method for producing a grain-oriented electrical steel sheet by comprising a series of steps of hot rolling a raw steel material comprising C: 0.002-0.10 mass %, Si: 2.0-8.0 mass %, Mn: 0.005-1.0 mass % and the remainder being Fe and inevitable impurities to obtain a hot rolled sheet, subjecting the hot rolled steel sheet to a hot band annealing as required and further to one cold rolling or two or more cold rollings including an intermediate annealing therebetween to obtain a cold rolled sheet having a final sheet thickness, subjecting the cold rolled sheet to primary recrystallization annealing combined with decarburization annealing, applying an annealing separator to the steel sheet surface and then subjecting to final annealing, characterized in that rapid heating is performed at a rate of not less than 50° C./s in a region of 200-700° C. in the heating process of the primary recrystallization annealing, and the steel sheet is held at any temperature of 250-600° C. in the region of 200-700° C. for 1-5 seconds, while a soaking process of the primary recrystallization annealing is controlled to a temperature range of 750-900° C., a time of 90-180 seconds and $P_{H2O}/P_{H2}$ in an atmosphere of 0.25-0.40, where $P_{H2O}$ means a partial water vapor pressure of the atmosphere and $P_{H2}$ means a partial hydrogen pressure of the atmosphere.

2. The method for producing a grain-oriented electrical steel sheet according to claim 1, wherein the raw steel material further contains Al: 0.010-0.050 mass % and N: 0.003-0.020 mass %, or Al: 0.010-0.050 mass %, N: 0.003-0.020 mass %, Se: 0.003-0.030 mass % and/or S: 0.002-0.03 mass %.

3. The method for producing a grain-oriented electrical steel sheet according to claim 2, wherein the steel sheet is subjected to nitriding treatment on the way of or after the primary recrystallization annealing to increase nitrogen content in the steel sheet to 50-1000 massppm.

4. The method for producing a grain-oriented electrical steel sheet according to claim 3, wherein the raw steel material further contains one or more selected from the group consisting of Ni: 0.010-1.50 mass %, Cr: 0.01-0.50 mass %, Cu: 0.01-0.50 mass %, P: 0.005-0.50 mass %, Sb: 0.005-0.50 mass %, Sn: 0.005-0.50 mass %, Si; 0.005-0.50 mass %, Mo: 0.005-0.10 mass %, B: 0.0002-0.0025 mass %, Te: 0.0005-0.010 mass %, Nb: 0.0010-0.010 mass %, V: 0.001-0.010 mass % and Ta: 0.001-0.010 mass %.

5. The method for producing a grain-oriented electrical steel sheet according to claim 2, wherein the raw steel material further contains one or more selected from the group consisting of Ni: 0.010-1.50 mass %, Cr: 0.01-0.50 mass %, Cu: 0.01-030 mass %, P: 0.005-0.50 mass %, Sb: 0.005-0.50 mass %, Sn: 0.005-0.50 mass %, Si: 0.005-0.50 mass %, Mo: 0.005-0.10 mass %, B: 0.0002-0.0025 mass %, Te: 0.0005-0.010 mass %, Nb: 0.0010-0.010 mass %, V: 0,001-0,010 mass % and Ta: 0,001-0,010 mass %.

6. The method for producing a grain-oriented electrical steel sheet according to claim 1, wherein the steel sheet is subjected to nitriding treatment on the way of or after the primary recrystallization annealing to increase nitrogen content in the steel sheet to 50-1000 massppm.

7. The method for producing a grain-oriented electrical steel sheet according to claim 6, wherein the raw steel material further contains one or more selected from the group consisting of Ni: 0.010-1.50 mass %, Cr: 0.01-0.50 mass %, Cu: 0.01-0.50 mass %, P: 0.005-0.50 mass %, Sb: 0.005-0.50 mass %, Sn: 0.005-0.50 mass %, Bi: 0.005-0.50 mass %, Mo: 0.005-0.10 mass %, B: 0.0002-0.0025 mass %, Te: 0.0005-0.010 mass %, Nb: 0.0010-0.010 mass %, V: 0.001-0.010 mass % and Ta: 0.001-0.010 mass %.

8. The method for producing a grain-oriented electrical steel sheet according to claim 1, wherein the raw steel material further contains one or more selected from the group consisting of Ni: 0.010-1.50 mass %, Cr: 0.01-0.50 mass %, Cu: 0.01-0.50 mass %, P: 0.005-0.50 mass %, Sb: 0.005-0.50 mass %, Sn: 0.005-0.50 mass %, Bi: 0.005-0.50 mass %, Mo: 0.005-0.10 mass %, B: 0.0002-0.0025 mass %, Te: 0.0005-0.010 mass %, Nb: 0.0010-0.010 mass %, V: 0.001-0.010 mass % and Ta: 0.001-0.010 mass %.

9. A method for producing a grain-oriented electrical steel sheet by comprising a series of steps of hot rolling a raw steel material comprising C: 0.002-0.10 mass %, Si: 2.0-8.0 mass %, Mn: 0.005-1.0 mass % and the remainder being Fe and inevitable impurities to obtain a hot rolled sheet, subjecting the hot rolled steel sheet to a hot band annealing as required and further to one cold rolling or two or more cold rollings including an intermediate annealing therebetween to obtain a cold rolled sheet having a final sheet thickness, subjecting the cold rolled sheet to primary recrystallization annealing combined with decarburization annealing, applying an annealing separator to the steel sheet surface and then subjecting to final annealing, characterized in that rapid heating is performed at a rate of not less than 50° C./s in a region of 200-700° C. in the heating process of the primary recrystallization annealing, and the steel sheet is held at any temperature of 250-600° C. in the region of 200-700° C. for 1-5 seconds, wherein a soaking process of the primary recrystallization annealing is divided into N stages (N: an integer of not less than 2), and the process from the first stage to (N−1) stage is controlled to a temperature of 750-900° C., a time of 80-170 seconds and $P_{H2O}/P_{H2}$ in an atmosphere of 0.25-0.40, and the process of the final N stage is further controlled to a temperature of 750-900° C., a time of 10-60 seconds and $P_{H2O}/P_{H2}$ in an atmosphere of not more than 0.20, where $P_{H2O}$ means a partial water vapor pressure of the atmosphere and $P_{H2}$ means a partial hydrogen pressure of the atmosphere.

10. The method for producing a grain-oriented electrical steel sheet according to claim 9, wherein the raw steel material further contains Al; 0.010-0.050 mass % and N: 0.003-0.020 mass %, or Al: 0.010-0.050 mass %, N: 0.003-0.020 mass %, Se: 0.003-0.030 mass % and/or S: 0.002-0.03 mass %.

11. The method for producing a grain-oriented electrical steel sheet according to claim 9, wherein the steel sheet is subjected to nitriding treatment on the way of or after the primary recrystallization annealing to increase nitrogen content in the steel sheet to 50-1000 massppm.

12. The method for producing a grain-oriented electrical steel sheet according to claim 9, wherein the raw steel material further contains one or more selected from the group consisting of Ni: 0.010-1.50 mass %, Cr: 0.01-0.50 mass %, Cu: 0.01-0.50 mass %, P: 0.005-0.50 mass %, Sb: 0.005-0.50 mass %, Sn: 0.005-0.50 mass %, Bi: 0.005-0.50 mass %, Mo: 0.005-0.10 mass %, B: 0.0002-0.0025 mass %, Te: 0.0005-0.010 mass %, Nb: 0.0010-0.010 mass %, V: 0.001-0.010 mass % and Ta: 0.001-0.010 mass %.

13. A method for producing a grain-oriented electrical steel sheet by comprising a series of steps of hot rolling a raw steel material comprising C: 0.002-0.10 mass %, Si: 2.0-8.0 mass %, Mn: 0.005-1.0 mass % and the remainder being Fe and inevitable impurities to obtain a hot rolled sheet, subjecting the hot rolled steel sheet to a hot band annealing as required and further to one cold rolling or two or more cold rollings including an intermediate annealing therebetween to obtain a cold rolled sheet having a final sheet thickness, subjecting the cold rolled sheet to primary recrystallization annealing combined with decarbunzation annealing, applying an annealing separator to the steel sheet surface and then subjecting to final annealing, characterized in that rapid heating is performed at a rate of not less than 50° C./s in a region of 200-700° C. in the heating process of the primary recrystallization annealing, and the steel sheet is held at any temperature of 250-600° C. in the region of 200-700° C. for 1-5 seconds, wherein a soaking process of the primary recrystallization annealing is divided into N stages (N: an integer of not less than 2), the first stage is controlled to a temperature of 820-900° C., a time of 10-60 seconds and $P_{H2O}/P_{H2}$ in an atmosphere of 0.25-0.40, and the second and later stages are controlled to a temperature of 750-900° C., a time of 80-170 seconds and $P_{H2O}/P_{H2}$ in an atmosphere of 0.25-0.40, provided that the temperature of the first stage is higher than those of the second and later stages, where $P_{H2O}$ means a partial water vapor pressure of the atmosphere and $P_{H2}$ means a partial hydrogen pressure of the atmosphere.

14. The method for producing a grain-oriented electrical steel sheet according to claim 13, wherein the raw steel material further contains Al: 0.010-0.050 mass % and N: 0.003-0.020 mass %, or Al: 0,010-0,050 mass %, N: 0.003-0.020 mass %, 0.003-0.030 mass % and/or S: 0.002-0.03 mass %.

15. The method for producing a grain-oriented electrical steel sheet according to claim 13, wherein the steel sheet is subjected to nitriding treatment on the way of or after the primary recrystallization annealing to increase nitrogen content in the steel sheet to 50-1000 massppm.

16. The method for producing a grain-oriented electrical steel sheet according to claim 13, wherein the raw steel material further contains one or more selected from the group consisting of Ni: 0.010-1.50 mass %, Cr: 0.01-0.50 mass %, Cu: 0.01-0.50 mass %, P: 0.005-0.50 mass %, Sb: 0.005-0.50 mass %, Sn: 0.005-0.50 mass %, Bi: 0.005-0.50 mass %, Mo: 0.005-0.10 mass %, B: 0.0002-0.0025 mass %, Te: 0.0005-0.010 mass %, Nb: 0.0010-0.010 mass %, V: 0.001-0.010 mass % and Ta: 0.001-0.010 mass %.

17. A method for producing a grain-oriented electrical steel sheet by comprising a series of steps of hot rolling a raw steel material comprising C: 0.002-0.10 mass %, Si: 2.0-8.0 mass %, Mn: 0.005-1.0 mass % and the remainder being Fe and inevitable impurities to obtain a hot rolled sheet, subjecting the hot rolled steel sheet to a hot band annealing as required and further to one cold rolling or two or more cold rollings including an intermediate annealing therebetween to obtain a cold rolled sheet having a final sheet thickness, subjecting the cold rolled sheet to primary recrystallization annealing combined with decarburization annealing, applying an annealing separator to the steel sheet surface and then subjecting to final annealing, characterized in that rapid heating is performed at a rate of not less than 50° C./s in a region of 200-700° C. in the heating process of the primary recrystallization annealing, and the steel sheet is held at any temperature of 250-600° C. in the region of 200-700° C. for 1-5 seconds, wherein a soaking process of the primary recrystallization annealing is divided into N stages (N: an integer of not less than 3), and the first stage is controlled to a temperature of 820-900° C., a time of 10-60 seconds and $P_{H2O}/P_{H2}$ in an atmosphere of 0.25-0.40, and the second to (N−1) stages are controlled to a temperature of 750-900° C., a time of 70-160 seconds and $P_{H2O}/P_{H2}$ in an atmosphere of 0.25-0.40, and the last stage is controlled to a temperature of 750-900° C., a time of 10-60 seconds and $P_{H2O}/P_{H2}$ in an atmosphere of not more than 0.20, provided that the temperature of the first stage is higher than those of the second stage to the N−1 stage, where $P_{H2O}$ means a partial water vapor pressure of the atmosphere and $P_{H2}$ means a partial hydrogen pressure of the atmosphere.

18. The method far producing a grain-oriented electrical steel sheet according to claim 17, wherein the raw steel material further contains Al: 0.010-0.050 mass % and N: 0.003-0.020 mass %, or Al: 0.010-0.050 mass %, N: 0.003-0.020 mass %, Se: 0.003-0.030 mass % and/or S: 0.002-0.03 mass %.

19. The method for producing a grain-oriented electrical steel sheet according to claim 17, wherein the steel sheet is subjected to nitriding treatment on the way of or after the primary recrystallization annealing to increase nitrogen content in the steel sheet to 50-1000 massppm.

20. The method for producing a grain-oriented electrical steel sheet according to claim 17, wherein the raw steel material further contains one or more selected from the group consisting of Ni: 0.010-1.50 mass %, Cr: 0.01-0.50 mass %, Cu: 0.01-0.50 mass %, P: 0.005-0.50 mass %, Sb: 0.005-0.50 mass %, Sn: 0.005-0.50 mass %, Bi: 0.005-0.50 mass %, Mo: 0.005-0.10 mass %, B: 0.0002-0.0025 mass %, Te: 0.0005-0.010 mass %, Nb: 0.0010-0.010 mass %, V: 0.001-0.010 mass % and Ta: 0,001-0,010 mass %.

* * * * *